US005253884A

United States Patent [19]

Landers

[11] Patent Number: 5,253,884

[45] Date of Patent: Oct. 19, 1993

[54] ROLLER ADJUSTMENT MEANS FOR IN LINE SKATE

[76] Inventor: Gary Landers, 173 W. 7th St., South Boston, Mass. 02127

[21] Appl. No.: 806,305

[22] Filed: Dec. 13, 1991

[51] Int. Cl.[5] ..... A63C 17/06

[52] U.S. Cl. ..... 280/11.27; 280/11.22; 280/43.17

[58] Field of Search ..... 280/11.22, 11.23, 11.27, 280/11.19, 7.13, 841, 43, 43.17

[56] References Cited

U.S. PATENT DOCUMENTS

| | | | |
|---|---|---|---|
| 576,106 | 2/1897 | Frankenberg et al. | 280/11.22 X |
| 1,068,829 | 7/1913 | Szymanski | 280/7.13 |
| 1,534,601 | 4/1925 | Matveyeff | 280/11.23 |
| 1,790,423 | 1/1931 | Hooks | 280/11.27 X |
| 1,880,915 | 10/1932 | Dyer | 280/43 X |
| 2,145,219 | 1/1939 | Burton | 280/43 X |
| 2,558,311 | 6/1951 | Morrow | 280/43 X |
| 3,649,828 | 3/1972 | Price | 280/43.17 |
| 3,884,485 | 5/1975 | Walle | 280/841 |
| 4,909,523 | 3/1990 | Olson | 280/11.22 X |
| 5,046,746 | 9/1991 | Gierveld | 280/11.22 |
| 5,092,614 | 3/1992 | Malewicz | 280/11.27 X |

FOREIGN PATENT DOCUMENTS

| | | | |
|---|---|---|---|
| 277009 | 7/1914 | Fed. Rep. of Germany | 280/11.27 |
| 67893 | 4/1951 | Netherlands | 280/7.13 |

*Primary Examiner*—Brian Johnson

*Attorney, Agent, or Firm*—Testa, Hurwitz & Thibeault

[57] ABSTRACT

A lever arrangement is provided to adjust the height of one or more rollers of an in line skate. The lever arrangement is rotatably mounted between an axle for a roller and a bracket for supporting the roller axle and is mounted on both ends of the axle. The axle extends through a rotatable bushing at one end of the lever arrangement having an off-center hole for the axle. A lock is provided at a second end of the lever arrangement.

4 Claims, 3 Drawing Sheets

ROLLER ADJUSTMENT MEANS FOR IN LINE SKATE

BACKGROUND OF THE INVENTION

This invention relates to a means for adjusting the height of one or more rollers of an in line skate.

At the present time recreational in line skates are available which have a boot section adapted to fit over the foot of a user and rollers attached to the boot section. The rollers are aligned in one row rather than two rows as has been the roller arrangement for roller skates. The use of in line skates is able to achieve speeds in excess of about 30 miles per hour on a flat surface which speeds are much faster than can be achieved by the user with a conventional (or non-tandem wheeled) roller skates. These high speeds are achieved when the axles supporting the rollers are positioned at the same height so that all rollers contact the ground. In an alternative mode of use, one or more internal rollers in the line of rollers are lowered by lowering the axles for the rollers. When the rollers are in this position, the skater is able to execute quick turns to quickly change the direction of his movement.

At the present time a height adjustment mechanism is provided for roller axles for in line skates which is secured to a bracket for the roller axles, which, in turn, is secured to the boot section of the in line skate. The mechanism comprises a fixed bushing having a non-circular shape which fits into a mating hole extending through the bracket. The fixed bushing has an ellipsoidal boss which is inserted through the bracket. The fixed bushing has a hole extending through it which accomodates an axle for the roller. The fixed bushing can be removed by hand from the bracket, rotated to a second position and reinserted into the bracket hole in order to fix it within the bracket in this second position. When in the second position, the axle hole through the bushing is positioned at a different height than the height of the axle in its original position. By operating in this manner, it is possible to adjust the height of the roller axles and the roller. This axle height adjustment system is undesirable since it requires the skater to remove the wheel and axle from the skate in order to reposition the stationery bushing. This procedure is time consuming and requires the use of special tools. In addition, the separated parts are small and can be easily lost.

Accordingly, it would be desirable to provide a means for adjusting the height of roller axles for in line skates which can be practiced quickly by hand without the need for disassembling any part of the skate and without the need for special tools.

SUMMARY OF THE INVENTION

The present invention provides a system for adjusting the height of an axle for a roller for in line skates. The system comprises a rotatable bushing fixed to a handle or lever. At one end of the handle means for locking the rotatable bushing to a desired position is provided. The rotatable bushing is provided with a hole which is positioned off center from the center of rotation of the rotatable bushing. The rotatable bushing is positioned in a circular hole in a bracket which, in turn, supports the axles of the skate rollers. A roller axle extends through the hole in the rotatable bushing. The height of the hole in the rotatable bushing is changed by rotating the rotatable bushing and the height is fixed by locking means in position. A rotatable bushing is positioned at both end portions on the axle. The height adjustment system can be utilized on one or more roller axles.

DESCRIPTION OF SPECIFIC EMBODIMENTS

The roller axle height adjustment means of this invention utilizes a rotatable bushing having a hole through which a skate roller axle extends. A rotatable bushing is provided at each end section of an axle. A handle is formed integrally with the roller bushing. The handle includes a locking means which functions to lock the rotatable bushing in place after it has been rotated to a desired position. The handle also provides a means for rotating the rotatable bushing by hand without the need for removing or loosening the rotatable bushing from position in a skate bracket which also supports the roller axle. The roller axle is positioned through the through hole so that the axle is supported by the rotatable bushing which, in turn, is supported by the bracket. The through hole is positioned off center from the center of rotation of the rotatable bushing. The locking means is positioned in a plurality of locking positions which, in turn, causes the through hole to be positioned in one of a plurality of different vertical heights.

In use, both rotatable bushings are rotated to the same desired position simultaneously in order to position the through holes in each bushing at the same vertical height. This is effected manually by grasping a handle intergrally formed with the rotatable bushing and rotating the handle. The handle then is locked in place by means including the bracket which supports the roller axles of the skate. This height adjustment system is used on one or a plurality of roller axles and which are normally positioned on one or more intermediate axles in the line of roller axles on the skate. This height adjustment can be effected by hand without the need for special tools and without the need for disassembling or loosening any portion of the skate.

Figure 1:
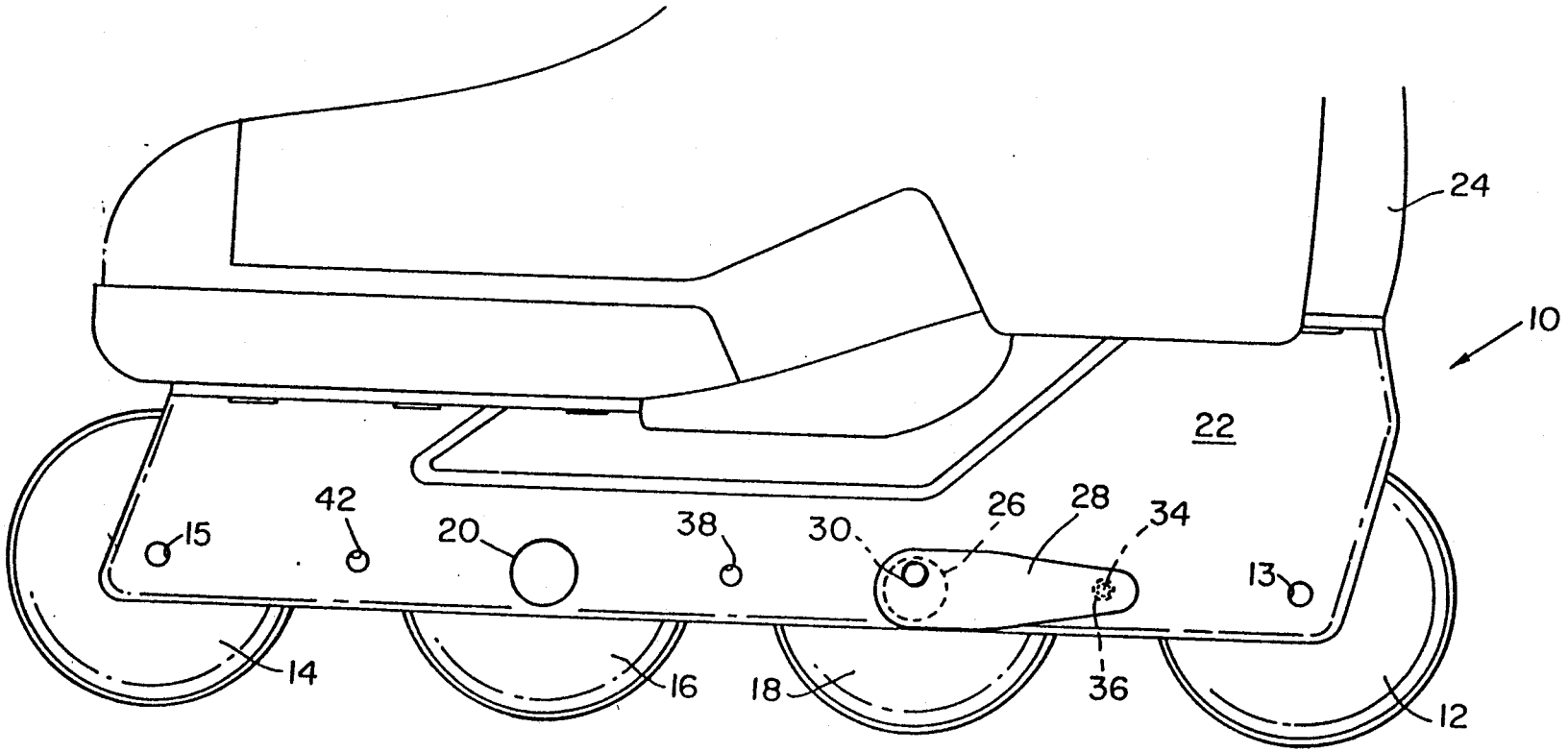
FIG. 1 is a side view of an in line skate with the roller axle height adjustment means of this invention.
Figure 3:
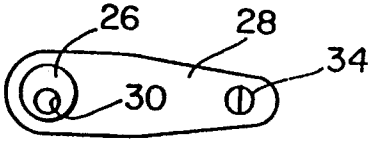
FIG. 3 is a side view of the height adjustment means shown in FIG. 2.
Figure 2:
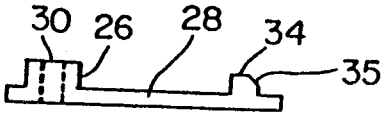
FIG. 2 is a top view of the height adjustment means shown in FIG. 1.

Referring to FIG. 1–3, the in line skate 10 comprises a plurality of rollers including end rollers 12 and 14 and intermediate rollers 16 and 18. Rollers 16 and 18 are provided with roller axle height adjustment means of this invention. With rollers 16 and 18, a circular hole 20 is provided in fixed bracket 22 which, in turn, is fixed to boot section 24. The hole 20 is of a size which permits the circular rotatable bushing 26 to be snugly fit while permitting its rotation within hole 20. A handle or lever 28 is secured to or formed integrally with bushing 26. The bushing 26 includes a through hole 30 which extends through handle 28 and is of a size which permits an axle for the roller 16 or 18 to be passed therethrough. A locking means 34 is positioned on the handle 28. The hole 30 is positioned off center from the center of rotation of the bushing 26. The locking means 34 for roller 18 can be positioned in hole 36 or in hole 38 in bracket 22. More than two holes can be utilized to lock the rotatable bushings in more than two positions, if desired. The holes 20 have centers which are offset downward from the center of holes 13 and 15 which house axles for rollers 12 and 14 so that the rollers 12, 14, 16 and 18 are at the same height at one of the two positions of lever 28. A locking means associated with a second pair of rotatable bushings 26 for roller 16 can be positioned in hole 38 or hole 42. The locking means can include a chamfered surface 35 which permits the locking means to be easily inserted into holes 36, 38 or 42. For convenience, when the handle 28 extends in the same direction, such as when locking means 34 are positioned in holes 36 and 38, rollers 16 and 18 are at the same height as rollers 12 and 14. In at least one second position, the rollers 16 and 18 are at different heights than that of rollers 12 and 14. Other locking means than extension 34 can be used. For example, an end of the lever 28 could be fit into a bracket formed integrally with bracket 22. All that is needed is that the lever 28 be held in place during use of the skate.

Figure 5:
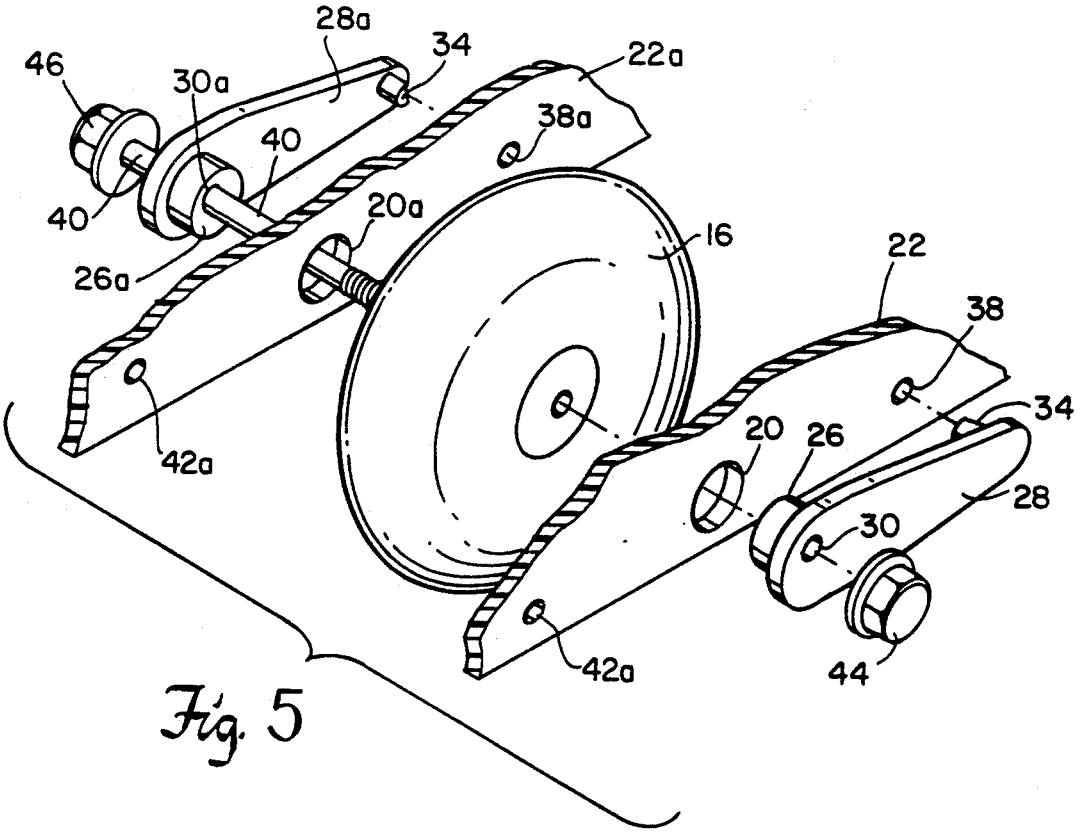
FIG. 5 is an exploded view of the height adjustment means of this invention wherein nut 44 has been omitted for clarity.

Referring to FIG. 5, the height adjustment means of this invention are shown in position on an in line skate. The rotatable bushings 26 and **26*a* are positioned on axle 40 which passes through holes 30 and 30*a*. The axle 40 also passes through brackets 22, 22*a* which are positioned on both sides of roller 16. The axle is secured in place by conventional means such as nuts 44 and 46. The levers 28 and 28*a* are positioned and locked in place so that the holes 30 and 30*a* are at the same height. For convenience of the user, this is effected when handles 28 and 28*a* extend in the same direction. The rotatable bushings 26 and 26*a* can be rotated in place within bracket 22 without the need for loosening nuts 44 or 46 and without the need for removing axles 40 from bracket 22**.

Figure 4:
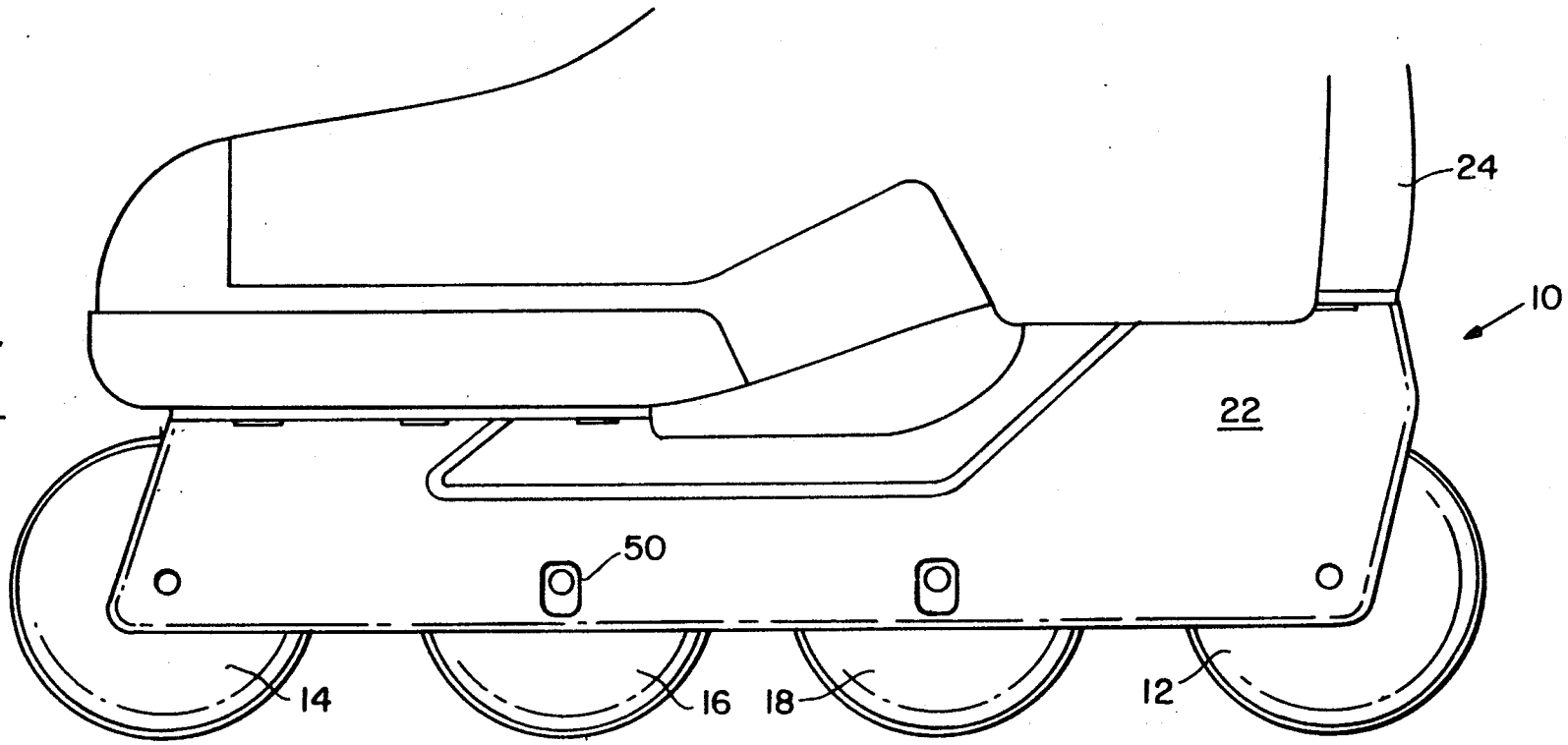
Fig. 4 PRIOR ART
FIG. 4 is a side view of an in line skate of the prior art.
Figure 4B:
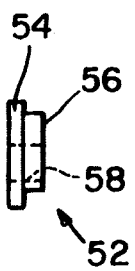
Fig. 4b PRIOR ART
FIG. 4*a* and 4*b* show the fixed bushing of the prior art.
Figure 4A:
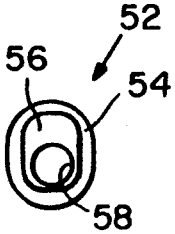
Fig. 4a PRIOR ART
Figure 6:
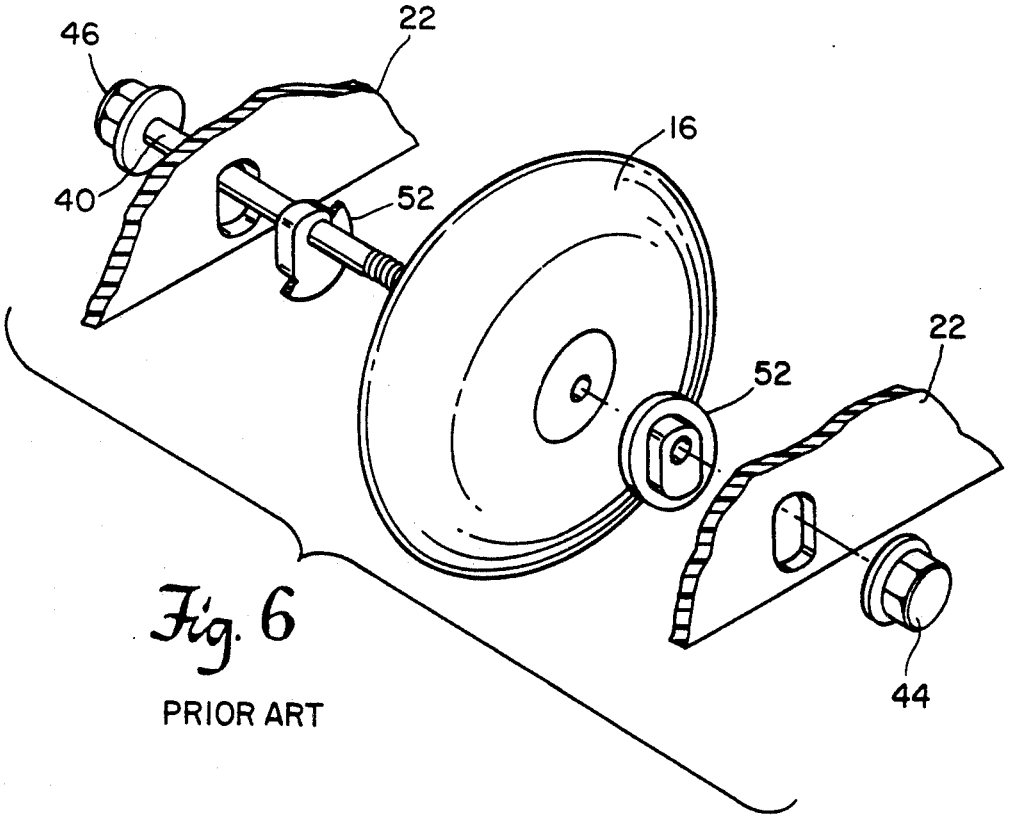
Fig. 6 PRIOR ART
FIG. 6 is an exploded view of the height adjustment means of the prior art.

Referring to FIGS. 4 and 6, the roller axle height adjustment means of the prior art is shown. The bracket 22 is provided with a noncircular hole 50 such as an elliptical hole as shown. A fixed bushing 52 includes a flange 54 and an elliptical boss 56 which fits in hole 50. Flange 54 serves to fix the bushing 52 in place in bracket 22. A through hole 58 is positioned off center from the center of the elliptical boss 56. Thus, hole 58 can be positioned concentrically or nonconcentrically in relation to rollers 12 and 14 directly relative to which of the two possible positions elliptical boss 56 is in. In order to change the position of fixed bushing 52 (See FIG. 6), the nuts 44 and 46 must be removed from axle 40 with a suitable tool so that axle 40 can be removed from bracket 22. The fixed bushings 52 then are removed by hand from the bracket 22, rotated 180° and then reinserted in bracket 22. Roller 16 and axle 40 then are repositioned in bracket 22 and the nuts 44 and 46 are secured to the axle with an appropriate tool. In this case as in FIG. 1, the center of elliptical hole 50 is also offset downwardly with respect to the concentrics of wheels 12 and 14 so that equilateral concentricity is only achievable in one position of 56 or 52. Thus, the prior art arrangement requires that the roller support structure be completely disassembled and reassembled.

I claim:

1. In combination with an in line skate having a boot, a frame supporting the boot, and a plurality of wheels rotatably mounted on axles supported by the frame, the improvement of a system for adjusting the height of at least one of the axles in relation to the frame, the system comprising a pair of opposed, coaxially rotatable bushings supported by the frame and each defining a through hole for passing the ends of a wheel axle, the axle-receiving through holes being located eccentrically to the bushings' rotational axis, securing means coupled to the wheel axle for securing the bushings and axle relative to the frame, a lever extending radially outwardly form each of the rotatable bushings for receiving a force to rotate the bushings, and locking means, formed with the frame, for releasably and replaceably receiving a portion of each of the levers to secure the bushings against unwanted rotation.

2. The combination as set forth in claim 1 wherein the system further comprises multiple pairs of opposed, rotatable bushings for adjusting the height of multiple axles in relation to the frame.

3. The combination as set forth in claim 1 wherein the locking means is capable of receiving a portion of the lever in one of two locations.

4. The combination as set forth in claim 3 wherein the locking means comprises a plurality of apertures located in the frame for lockingly receiving the portion of the lever.

* * * * *